United States Patent [19]

Plapper et al.

[11] 4,272,242

[45] Jun. 9, 1981

[54] USE OF WATER-INSOLUBLE ALUMINOSILICATES IN TANNING PROCESS FOR THE PRODUCTION OF LEATHER

[75] Inventors: Juergen Plapper, Hilden; Klaus Schumann, Erkrath; Milan J. Schwuger, Haan; Heinz G. Smolka, Langenfeld; Emanuel Arndt, Düsseldorf; Emil Ruscheinsky, Leverkusen, all of Fed. Rep. of Germany; Herman Jansen, Willingboro, N.J.

[73] Assignee: Henkel Kommanditgesellschaft auf Aktien, Düsseldorf-Holthausen, Fed. Rep. of Germany

[21] Appl. No.: 923,576

[22] Filed: Jul. 11, 1978

[30] Foreign Application Priority Data

| | | | |
|---|---|---|---|
| Jul. 16, 1977 | [DE] | Fed. Rep. of Germany | 2732217 |
| May 20, 1978 | [DE] | Fed. Rep. of Germany | 2822073 |
| May 20, 1978 | [DE] | Fed. Rep. of Germany | 2822074 |
| May 20, 1978 | [DE] | Fed. Rep. of Germany | 2822075 |

[51] Int. Cl.[3] ..... C14C 3/04; C14C 3/06

[52] U.S. Cl. ..... 8/94.15; 8/94.18; 8/94.19 R; 8/94.2; 8/94.25; 8/94.26; 8/94.27; 8/94.29; 8/94.3

[58] Field of Search ..... 8/94.29, 94.25, 94.26, 8/94.27, 94.28, 94.19, 94.18, 94.15, 94.2, 94.3

[56] References Cited

U.S. PATENT DOCUMENTS 3,096,143 7/1963 Horrigan ..... 8/94.25

FOREIGN PATENT DOCUMENTS 568180 3/1945 United Kingdom ..... 8/94.29

768762 2/1957 United Kingdom ..... 8/94.29

*Primary Examiner*—C. A. Henderson

*Attorney, Agent, or Firm*—Hammond & Littell, Weissenberger and Muserlian

[57] ABSTRACT

In the process of tanning for the production of leather comprising subjecting pickled uncured hides to the action of an aqueous liquor containing (1) chemical tanning or pretanning agents, and (2) auxiliary chemicals to tanning and recovering leather, the improvement consisting essentially of employing a water-insoluble aluminosilicate, containing bound water, of the formula $$(Cat_{2/n}O)_x.Al_2O_3.(SiO_2)_y$$

wherein Cat represents a cation selected from the group consisting of alkali metals, bivalent metal ions, trivalent metal ions and mixtures thereof, n represents an integer from 1 to 3 of the valence of the cation, x is an integer from 0.5 to 1.8 and y is an integer from 0.8 to 50, said aluminosilicates having an average particle size in the range of 0.1$\mu$ to 5 mm and a calcium binding power of from 0 to 200 mg CaO/gm of anhydrous active substance measured at 22° C. according to the Calcium Binding Power Test Method set out in the specification, as partial replacement of said chemical tanning or pretanning agents and said auxiliary chemicals to tanning.

32 Claims, No Drawings

USE OF WATER-INSOLUBLE ALUMINOSILICATES IN TANNING PROCESS FOR THE PRODUCTION OF LEATHER

BACKGROUND OF THE INVENTION

One of the most timely problems with leather production is the partial or complete replacement to be found for auxiliary agents, which put a high load on industrial sewage waters. This is the case particularly with the defatting and pretanning of pickled hides and the tanning of pelts and leather. Thereby aside from tanning matter other auxiliary agents, such as solvent and defatting agents, tensides, electrolytes, phosphates, neutralizers, etc. are utilized.

OBJECTS OF THE INVENTION

An object of the present invention is the improvement in the process of tanning for the production of leather comprising subjecting pickled uncured hides to the action of an aqueous liquor containing (1) chemical tanning or pretanning agents, and (2) auxiliary chemicals to tanning and recovering leather, the improvement consisting essentially of employing a water-insoluble aluminosilicate, containing bound water, of the formula $$(Cat_{2/n}O)_x.Al_2O_3.(SiO_2)_y$$

wherein Cat represents a cation selected from the group consisting of alkali metals, bivalent metal ions, trivalent metal ions and mixtures thereof, n represents an integer from 1 to 3 of the valence of the cation, x is an integer from 0.5 to 1.8 and y is an integer from 0.8 to 50, said aluminosilicates having an average particle size in the range of 0.1$\mu$ to 5 mm and a calcium binding power of from 0 to 200 mg CaO/gm of anhydrous active substance measured at 22° C. according to the Calcium Binding Power Test Method set out in the specification, as partial replacement of said chemical tanning or pretanning agents and said auxiliary chemicals to tanning.

Another object of the present invention is the improvement in the process of defatting and pretanning of pickled dehaired hides comprising subjecting pickled dehaired hides to the action of an aqueous liquor containing (1) surface-active compounds selected from the group consisting of anionic surface-active compounds and nonionic surface-active compounds, (2) electrolytes, and (3) sequestering agents, rinsing and recovering defatted pretanned hides, the improvement consisting essentially of employing a water-insoluble aluminosilicate, containing bound water, of the formula $$(Cat_{2/n}O)_x.Al_2O_3.(SiO_2)_y$$

wherein Cat represents a cation selected from the group consisting of alkali metals, bivalent metal ions, trivalent metal ions, and mixtures thereof, n represents an integer from 1 to 3 of the valence of said cation, x is an integer from 0.5 to 1.8 and y is an integer from 0.8 to 50, said aluminosilicates having an average particle size in the range of 0.1$\mu$ to 5 mm and a calcium binding power of from 0 to 200 mg CaO/gm of anhydrous active substance measured at 22° C. according to the Calcium Binding Power Test Method set out in the specification, as partial replacement of said surface-active compounds, electrolytes and sequestering agents.

A yet further object of the present invention is the improvement in the process of tanning uncured hides comprising subjecting uncured hides to the action of an aqueous liquor containing basic metal salt tanning agents, and tanning auxiliaries for a time sufficient to tan said hides, rinsing and recovering leather, the improvement consisting essentially of employing a water-insoluble aluminosilicate, containing bound water, of the formula $$(Cat_{2/n}O)_x.Al_2O_3.(SiO_2)_y$$

wherein Cat represents a cation selected from the group consisting of alkali metals, bivalent metal ions, trivalent metal ions and mixtures thereof, n represents an integer from 1 to 3 of the valence of the cation, x is an integer from 0.5 to 1.8 and y is an integer from 0.8 to 50, said aluminosilicates having an average particle size in the range of 0.1$\mu$ to 5 mm and a calcium binding power of from 0 to 200 mg CaO/gm of anhydrous active substance measured at 22° C. according to the Calcium Binding Power Test Method set out in the specification, as partial replacement of said basic metal salt tanning agent and tanning auxiliaries.

These and other objects of the present invention will become more apparent as the description thereof proceeds.

DESCRIPTION OF THE INVENTION

The object of the invention is to reduce the application of chemicals for leather production and to reduce the load on sewage waters from leather production. For this purpose according to the invention specified aluminosilicates are used, which are capable of partially or completely replacing the customarily used auxiliary agents and which because of their ecological free bill of health result in a considerable improvement of the sewage water situation.

This object is achieved by the use of water-insoluble, preferably bound-water containing aluminosilicates of the general formula $$(Cat_{2/n}O)_x.Al_2O_3.(SiO_2)_y$$

wherein Cat represents a cation selected from the group consisting of alkali metals, bivalent metal ions, trivalent metal ions and mixtures thereof, n represents an integer from 1 to 3 of the valence of the cation, x is an integer from 0.5 to 1.8 and y is an integer from 0.8 to 50, said aluminosilicates having an average particle size in the range of 0.1$\mu$ to 5 mm and a calcium binding power of from 0 to 200 mg CaO/gm of anhydrous active substance measured at 22° C. according to the Calcium Binding Power Test Method set out in the specification, for leather production.

The calcium binding power is determined according to the process given in the example section.

More particularly, the present invention relates to the improvement in the process of tanning for the production of leather comprising subjecting pickled uncured hides to the action of an aqueous liquor containing (1) chemical tanning or pretanning agents, and (2) auxiliary chemicals to tanning and recovering leather, the improvement consisting essentially of employing a water-insoluble aluminosilicate, containing bound water, of the formula $$(Cat_{2/n}O)_x.Al_2O_3.(SiO_2)_y$$

wherein Cat represents a cation selected from the group consisting of alkali metals, bivalent metal ions, trivalent metal ions and mixtures thereof, an represents an integer from 1 to 3 of the valence of the cation, x is an integer from 0.5 to 1.8 and y is an integer from 0.8 to 50, said aluminosilicates having an average particle size in the range of 0.1μ to 5 mm and a calcium binding power of from 0 to 200 mg CaO/gm of anhydrous active substance measured at 22° C. according to the Calcium Binding Power Test Method set out in the specification, as partial replacement of said chemical tanning or pretanning agents and said auxiliary chemicals to tanning.

The application of alkali metal aluminosilicates has been found particularly useful with the following processes:

A. Defatting and Pretanning of Pickled Dehaired Hides

The pickled dehaired hides frequently used as raw material for leather production are pretreated with salt and acid and thereby conserved. The pH value of the material in this state is less than 2.

In the defatting stage preceding the actual tanning absolute care must be taken that a damage of the skin structure by swelling is avoided. Generally this is done by employing a concentrated salt solution (6° to 8° Baumé). For defatting purposes, according to the type of tanning desired, anionic or nonionic tensides and applicably also solvents are added to the aqueous liquor.

Since the tanning effect of polyphosphates has become known, for lixiviating and defatting the skin material, polyphosphates such as hexametaphosphate are added. Because of their weak tanning effect any swelling is avoided.

The tanning effect itself, however, is not that pronounced as to establish the leather character already at this state of leather production.

The application of aluminosilicates to the defatting and pretanning of pickled dehaired hides results specifically in the following advantages:

(1) By saving on phosphates the danger of eutrophication of waters, produced by phosphate-containing sewage waters, is reduced.
(2) The use of solvents for the defatting of pickled hides can be partially or completely relinquished.
(3) Aluminosilicates have a considerably acid binding capacity and, therefore, a depickling effect.
(4) On the subsequent chrome tanning stage the formation of disturbingly colored chrome-phosphate complexes caused from the use of polyphosphates, is avoided.

A supplementary invention relates to the improvement in the process of defatting and pretanning of pickled dehaired hides comprising subjecting pickled dehaired hides to the action of an aqueous liquor containing (1) surface-active compounds selected from the group consisting of anionic surface-active compounds and nonionic surface-active compounds, (2) electrolytes, and (3) sequestering agents, rinsing and recovering defatted and pretanned hides, the improvement consisting essentially of employing a water-insoluble aluminosilicate, containing bound water, of the formula $$(Cat_{2/n}O)_x.Al_2O_3.(SiO_2)_y$$

wherein Cat represents a cation selected from the group consisting of alkali metals, bivalent metal ions, trivalent metal ions and mixtures thereof, n represents an integer from 1 to 3 of the valence of the cation, x is an integer from 0.5 to 1.8 and y is an integer from 0.8 to 50, said aluminosilicates having an average particle size in the range of 0.1μ to 5 mm and a calcium binding power of from 0 to 200 mg CaO/gm of anhydrous active substance measured at 22° C. according to the Calcium Binding Power Test Method set out in the specification, as partial replacement of said surface-active compounds, electrolytes and sequestering agents.

B. Tanning of Pelts and Leather

The most important type of tanning is the chrome tanning. It is based on the azido-complex formation and the agglomeration of basic chrome salts with collagen carboxyl groups.

Aside from above also other basic metal salts, such as of iron, aluminum, zirconium, titanium and silicon, have tanning properties. In practice, however, only specified aluminum and zirconium salts have been used as combination tanning matter. Silicon compounds practically have not been used at all, because the raw materials, mostly special water-glasses, are difficult to handle in an acidic tanning medium. Additionally, and specifically after mellowing, the leather quality in most cases is substandard, because hardening, brittle feel and loss of resistance to tearing can occur.

The application of aluminosilicates specifically to chrome tanning and/or combination tanning with chrome, aluminum, and silicon tanning agents produces the following advantages:

(1) By reducing the amount of chrome tanning agents, a considerable lightening of tannery sewage water is obtained. The chrome content of the sewage waters is reduced to a greater extent than proportionally. By comparison with pure chrome tanning, on reducing the chrome content in the liquor tanning bath by 50%, the sewage waters contain only a maximal 15% of the usual amount, as is disclosed from a publication of Dr. Siegfried Felten in "Water, Air, and Industry", No. 3, 1964.

(2) The described drawbacks of silicon tanning agents are avoided because aluminosilicates in an acidic tanning medium (pH 3 to 4.5) react to give sodium salts, aluminum salts, and polymeric silicic acids in the finest dispersion.

(3) In combination tanning aluminosilicates have a self-neutralizing effect because of their own consumption of acid. The application of additional neutralizers, therefore, can be relinquished. Simultaneously the tanning effect is increased.

(4) On neutralizing chrome leather, aluminosilicates used according to the invention can be applied as neutralizers without having the leather displeasingly discolored green by polyphosphates. Simultaneously they are effective as masking salt, so that any precipitation of high-basic chromic salts is avoided. Additionally, a retanning effect is obtained.

(5) Common salt and other electrolytes can be partially or completely saved, so that by comparison with customary processes the sewage waters contain only minor amounts of electrolytes.

(6) Aluminosilicates can be easily and safely stored and handled.

A further supplementary invention, therefore, relates to the improvement in the process of tanning uncured hides comprising subjecting uncured hides to the action of an aqueous liquor containing basic metal salt tanning agents, and tanning auxiliaries for a time sufficient to tan said hides, rinsing and recovering leather, the improvement consisting essentially of employing a water-insoluble aluminosilicate, containing bound water, of the formula $$(Cat_{2/n}O)_x.Al_2O_3.(SiO_2)_y$$

wherein Cat represents a cation selected from the group consisting of alkali metals, bivalent metal ions, trivalent metal ions and mixtures thereof, n represents an integer from 1 to 3 of the valence of the cation, x is an integer from 0.5 to 1.8 and y is an integer from 0.8 to 50, said aluminosilicates having an average particle size in the range of 0.1μ to 5 mm and a calcium binding power of from 0 to 200 mg CaO/gm of anhydrous active substance measured at 22° C. according to the Calcium Binding Power Test Method set out in the specification, as partial replacement of said basic metal salt-tanning agent and tanning auxiliaries.

The aluminosilicates to be used according to the invention are amorphous or crystalline, synthetic or natural products which meet the above-mentioned requirements. Of particular importance are those products where Cat in the above-mentioned formula denotes an alkali metal ion, preferably a sodium ion, x is a number from 0.7 to 1.5, y is a number from 0.8 to 6, preferably 1.3 to 4, whose average particle size is from 0.1 to 25μ, preferably 1 to 12μ, and which have a calcium binding power according to the Calcium Binding Power Test Method of 20 to 200 mg CaO/gm of anhydrous active substance. Of equal importance are products, which are identical with the above-mentioned products as far as the meaning of Cat, x, y and the calcium binding power is concerned, and which merely differ by a larger average particle size of more than 25μ to 5 mm.

Such alkali metal aluminosilicates can be produced synethetically in a simple manner, for example, by reaction of water-soluble silicates with water-soluble aluminates in the presence of water. For this purpose, aqueous solutions of the starting materials can be mixed with one another, or a component present in a solid state may be reacted with the other component present in the form of an aqueous solution.

The desired alkali metal aluminosilicates are also obtained by mixing the two components, present in a solid state, in the presence of water. Alkali metal aluminosilicates can also be produced from $$Al(OH)_3,\ Al_2O_3 \text{ or } SiO_2$$

by reaction with alkali metal silicate solution or aluminate solutions, respectively. Finally, substances of this type are also formed from the melt, although, owing to high melting temperatures required and the necessity of converting the melt into finely distributed products, this method appears to be less interesting from an economic viewpoint.

Many of these alkali metal aluminosilicates and their preparation are described in U.S. Pat. No. 4,071,377, as well as in U.S. patent application Ser. No. 458,306, filed Apr. 5, 1974, now abandoned in favor of its continuation Ser. No. 800,308, filed May 25, 1977, now abandoned in favor of its continuation-in-part Ser. No. 956,851, filed Nov. 2, 1978. These alkali metal aluminosilicates as produced by precipitation, or converted to an aqueous suspension in a finely distributed state by other methods, may be converted from the amorphous state into the aged or crystalline state by heating to temperatures of from 50° to 200° C. The amorphous or crystalline alkali metal aluminosilicate, present in an aqueous suspension, can be separated from the remaining aqueous solution by filtration and can be dried at temperatures of, for example, 50° to 800° C. The product contains a greater or smaller quantity of bound water according to the drying conditions. Anhydrous products are obtained by drying for 1 hour at 800° C. However, the hydrous products are preferred, particularly those obtained when drying at 50° to 400° C., particularly 50° to 200° C. Suitable products can have, for example, water contents of approximately 2% to 30%, usually approximately 8% to 27% relatively to their total weight.

The precipitation conditions can contribute to the formation of the desired small particle sizes of from 1 to 12μ, the intermixed aluminate and silicate solutions, which may also be introduced simultaneously into the reaction vessel, are subjected to high shearing forces by, for example, intensively agitating the suspension. When crystallized alkali metal aluminosilicates are produced (these are preferably used in accordance with the invention), the formation of large, possibly interpenetrating crystals, is thus prevented by slow agitation of the crystallizing compound.

Nevertheless, undesired agglomeration of crystal particles can occur, particularly during drying, so that it may be advisable to remove these secondary particles in a suitable manner by, for example, air separators. Alkali metal aluminosilicates obtained in a coarser state, and which have been ground to the desired grain size, can be used. By way of example, mills and/or air separators, or combinations thereof, are suitable for this purpose.

Preferred products are, for example, synthetically produced crystalline alkali metal aluminosilicates of the composition.

$$0.7-1.1M_2O.Al_2O_3{:}1.3-3.3SiO_2$$

in which M represents an alkali metal cation, preferably a sodium cation. It is advantageous if the alkali metal aluminosilicate crystallites have rounded corners and edges.

If it is desired to produce the alkali metal aluminosilicates with rounded corners and edges, it is advantageous to start with a preparation whose molar composition lies preferably in the range.

$$2.5\text{-}6.0M_2O.Al_2O_3.0.5\text{-}5.0SiO_2.60\text{-}200H_2O$$

wherein M has the meaning given above and, in particular, signifies the sodium ion. This preparation is crystallized in a conventional manner. Advantageously, this effected by heating the preparation for at least ½ hour to 70° to 120° C., preferably to 80° to 95° C., under agitation. The crystalline product is isolated in a simple manner by separating the liquid phase. If required, it is advisable to re-wash the products with water, and to dry them before further processing. Even when working with a preparation whose composition differs only slightly from that stated above, one still obtains products having rounded corners and edges, particularly when the difference only relates to one of the four concentration parameters given above.

Furthermore, fine-particulate water-insoluble alkali metal aluminosilicates may also be used in the method of the invention which have been precipitated and aged or crystallized in the presence of water-soluble inorganic or organic dispersing agents. Products of this type are described in U.S. patent applications Ser. No. 503,467, filed Sept. 5, 1974, now abandoned; Ser. No. 763,667, filed Jan. 28, 1977, now abandoned; and Ser. No. 811,964, filed June 30, 1977 now U.S. Pat. No. 4,126,574. They are obtainable in a technically simple manner. Suitable water-soluble organic dispersing agents are surface-active compounds, non-surface-active-like aromatic sulfonic acids and compounds having a complex-forming capacity for calcium. The said dispersing agents may be introduced into the reaction mixture in an optional manner before or during precipitation, and, for example, they may be introduced in the form of a solution or they may be dissolved in the aluminate solution and/or silicate solution. Particularly satisfactory effects are obtained when the dispersing agent is dissolved in the silicate solution. The quantity of dispersing agent should be at least 0.05 percent by weight, preferably 0.1 to 5 percent by weight, based on the total amount of precipitate obtained. The product of precipitation is heated to temperatures of from 50° to 200° C. for ½ to 24 hours for the purpose of ageing or crystallization. By way of example, sodium lauryl ether sulfate, sodium polyacrylate, hydroxyethane diphosphonate and others may be mentioned from the large number of dispersing agents which may be used.

Compounds of the general formula $$0.7\text{-}1.1Na_2O.Al_2O_3.>2.4\text{-}3.3SiO_2$$

constitute a special variant, with respect to their crystal structure, of the alkali metal aluminosilicates to be used in accordance with the invention.

Compounds of the formula $$0.7\text{-}1.1Na_2O.Al_2O_3>3.3\text{-}5.3SiO_2$$

constitute a further variant of the water-insoluble aluminosilicates to be used in accordance with the invention. The production of such products is based on a preparation whose molar composition lies preferably in the range $$2.5\text{-}4.5Na_2O.Al_2O_3.3.5\text{-}6.5SiO_2.50\text{-}110H_2O$$

This preparation is crystallized in a conventional manner. Advantageously, this is effected by heating the preparation for at least ½ hour to 100° to 200° C., preferably to 130° to 160° C., under vigorous agitation. The crystalline product is isolated in a simple manner by separation of the liquid phase. If required, it is advisable to wash the products with water, and to dry them at temperatures of from 20° to 200° C., before further processing. The dried products thus obtained still contain bound water. When the products are produced in the manner described, one obtains very fine crystallites which come together to form spherical particles, possibly to form hollow balls having a diameter of approximately 1 to 4μ.

Furthermore, alkali metal aluminosilicates suitable for use in accordance with the invention are those which can be produced from calcinated (destructured) kaolin by hydrothermal treatment with aqueous alkali metal hydroxide. The formula $$0.7\text{-}1.1M_2O.Al_2O_3.1.3\text{-}2.4SiO_2.0.5\text{-}5.0H_2O$$

corresponds to the products, M signifying an alkali metal cation, particularly a sodium cation. The production of the alkali metal aluminosilicates from calcinated kaolin leads, without any special technical expense, directly to a very fine-particulate product. The kaolin, previously calcinated at 500° to 800° C., is hydrothermally treated with aqueous alkali metal hydroxide at 50° to 100° C. The crystallization reaction thereby taking place is generally concluded after 0.5 to 3 hours.

Commercially available, elutriated kaolins predominantly comprise the clay mineral kaolinite of the approximate composition $Al_2O_3.2SiO_2.2H_2O$ and which has a layer structure. In order to obtain the alkali metal metal aluminosilicates, to be used in accordance with the invention, therefrom by hydrothermal treatment with alkali hydroxide, it is first necessary to destructure the kaolin, this being effected to best advantage by heating the kaolin to temperatures of from 500° to 800° C. for two to four hours. The X-ray amorphous anhydrous metakaolin is thereby produced from the kaolin. In addition to destructuring the kaolin by calcination, the kaolin can also be destructured by mechanical treatment (grinding) or by acid treatment.

The kaolins usable as starting materials are light-colored powders of great purity; of course, their iron content of approximately 2000 to 10,000 ppm Fe is substantially higher than the values of from 20 to 100 ppm Fe in the alkali metal aluminosilicates produced by precipitation from alkali metal silicate and alkali metal aluminate solutions. This higher iron content in the alkali metal aluminosilicates produced from kaolin is not disadvantageous, since the iron is firmly bedded in the form of iron oxide in the alkali metal aluminosilicate lattice and is not dissolved out. A sodium aluminosilicate having a cubic, faujasite-like structure is produced during the hydrothermal action of sodium hydroxide on destructured kaolin. Production of such alkali metal aluminosilicates from destructured kaolin with a low iron content are described in U.S. patent application Ser. No. 819,666, filed July 28, 1977, now U.S. Pat. No. 4,089,929.

Alkali metal aluminosilicates, usable in accordance with the invention, may also be produced from calcinated (destructured) kaolin by hydrothermal treatment with aqueous alkali metal hydroxide with the addition of silicon dioxide or a compound producing silicon dioxide. The mixture of alkali metal aluminosilicates of differing crystal structure, generally obtained thereby, comprises very fine-particulate crystal particles having a diameter of less than 20μ, and 100% of which usually comprises particles having a diameter of less than 10μ. In practice, this conversion of the destructured kaolin is effected preferably with aqueous sodium hydroxide and water glass. A sodium aluminosilicate J is thereby produced which is known by several names in the literature, for example, molecular sieve 13 X or zeolite NaX (see O. Grubner, P. Jiru and M. Rálek, "Molecular Sieves", Berlin 1968, page 32, 85-89), when the preparation is preferably not agitated during the hydrothermal treatment at all events when only low shearing energies are used and the temperature preferably remains at 10° to 20° C. below the boiling temperature (approximately 103° C.). The sodium aluminosilicate J has a cubic crystal structure similar to that of natural faujasite. The conversion reaction may be influenced particularly by agitating the preparation, at elevated temperature (boiling heat at normal pressure or in an autoclave) and greater quantities of silicate, that is, by a molar preparation ratio $SiO_2$:$Na_2O$ at least 1, particularly 1.0 to 1.45. such that sodium aluminosilicate F is produced in addition to, or instead of, sodium aluminosilicate J. Sodium aluminosilicate F is designated "zeolite P" or "type B" in the literature (see D. W. Breck, "Zeolite Molecular Sieves", New York, 1974, page 72). Sodium alumiosilicate F has a structure similar to the natural zeolites gismondine and garronite and is present in the form of crystallites having an externally spherical appearance. In general, the conditions for producing the sodium aluminosilicate F and for producing mixtures of J and F are less critical than those for a pure crystal type A.

The above-described types of different alkali metal aluminosilicates can also be produced without difficulties in a coarser form with particle sizes of more than 25μ to 5 mm, in addition to the finely-divided form with particles sizes of 0.2 to 25μ. This can be done either by omitting the measures that prevent large crystal growth or agglomeration, or by transforming the finely-divided product subsequently in known manner into the granulated form. The desired particle size can be adjusted subsequently, if desired, by grinding and air sifting.

For use in the manufacture of leather, aluminosilicates also can be used where Cat in the above formula denotes an alkali metal ion and/or a bivalent and/or trivalent cation, where Cat consists at least of 20% of alkali metal ions, preferably sodium ions, x denotes a number from 0.7 to 1.5, n a number from 1 to 3, y a number from 0.8 to 6, preferably 1.3 to 4, with a particle size of 0.1μ to 5 mm, and a calcium-binding power to 20 to 200 mg CaO/gm of anhydrous active substance when measured according to the Calcium Binding Power Test Method.

For the production of aluminosilicates containing bivalent or trivalent cations, the above-mentioned reactions for the preparation of the alkali metal aluminosilicates can be carried out in some cases with aluminates or silicates which already contain the corresponding cations in salt form. In general, corresponding aluminosilicates are obtained in known manner by ion exchange from alkali metal aluminosilicates with polyvalent cations, e.g. calcium, magnesium, zinc or aluminum ions.

Examples of aluminosilicates, where the alkali metal cations are partly replaced by polyvalent cations, particularly calcium, magnesium, or zinc ions, are represented by the following formulas, bound water not shown;

$0.8CaO.0.2Na_2O.Al_2O_3.2SiO_2$, $0.4CaO.0.5Na_2O.Al_2O_3.SiO_2$, $0.18MgO.0.77Na_2O.Al_2O_3.1.9SiO_2$, $0.16MgO.0.8Na_2O.Al_2O_3.2.05SiO_2$, $0.11ZnO.0.92Na_2O.Al_2O_3.2SiO_2$.

The products contain about 8% to 27% by weight of bound water. They can be used in their crystalline, as well as in their amorphous forms.

Other aluminosilicates suitable for use according to the invention are those where Cat in the above formula denotes an alkali metal ion and/or a bivalent and/or trivalent cation, x a number from 0.5 to 1.8, y a number from 0.8 to 6, preferably 1.3 to 4, with a particle size of 0.1μ to 5 mm, and a calcium binding power of 0 to <20 mg CaO/gm of anhydrous active substance.

Among the aluminosilicates of this group are amorphous, or crystalline, synthetic or natural products. They can be synthetized in a simple manner, for example, by reacting water-soluble silicates with water-soluble aluminates in the presence of water, as it was described principally in the preceding production methods. As examples of such products we mention the following aluminosilicates:

$1.05Na_2O.Al_2O_3.3.8SiO_2Ca$ binding power 0 mg CaO/gm $1.0Na_2O.Al_2O_3.2.1SiO_2Ca$ binding power 16 mg CaO/gm $0.05Na_2O.0.94CaO.Al_2O_3.1.92SiO_2Ca$ binding power <15 mg CaO/gm $0.09Na_2O.0.82MgO.Al_2O_3.2.38SiO_2Ca$ binding power <15 mg CaO/gm Also, for use according to the invention in the manufacture of leather suitable aluminosilicates can be employed where Cat in the above formula denotes an alkali metal ion and/or a bivalent and/or trivalent cation, x a number from 0.5 to 1.8, y a number from >6 to 20, with a particle size of 0.1μ to 5 mm, and a calcium-binding power of 0 to 200 mg Cao/gm anhydrous substance according to the Calcium Binding Power Test Method.

These aluminosilicates can be amorphous or crystalline and be of synthetic or natural origin. They can be synthetized in a simple manner, such as, by reacting water-soluble silicates with water-soluble aluminates in the presence of water. To this end, aqueous solutions of the starting material can be mixed with each other, or one component, which is present in solid form, can be reacted with the other component, which is present as an aqueous solution. The introduction of polyvalent cations can be effected according to methods known from the literature by exchanging monovalent cations, for example, sodium ions, with bivalent and trivalent cations, such as calcium, magnesium, zinc or aluminum ions. The natural aluminosilicates can also contain other cations in a fluctuating, mostly small amount in addition to the above-mentioned cations. Among these are alkali metals such as lithium, potassium; thallium; manganese; cobalt; and nickel ions. Synthetic aluminosilicates can also contain, as cations, quaternary nitrogen compounds, such as ammonium ions, in varying amounts. The extent to which the aluminosilicates are laden with the above-mentioned cations depends largely on the size of the coefficient of selectivity. Preferably, however, aluminosilicates of the above-indicated general composition are used, where Cat in the above-mentioned formula is an alkali metal ion, preferably a sodium ion. Examples of these products are represented by the following formulas:

$1.3Na_2O.Al_2O_3.13.4SiO_2$ $0.6Na_2O.Al_2O_3.8.3SiO_2$ $1.1Na_2O.Al_2O_3.14.8SiO_2$ $1.5Na_2O.Al_2O_3.12.2SiO_2$ $1.5Na_2O.Al_2O_3.11.8SiO_2$

An essential criterion for the usability of all the above mentioned aluminosilicates according to the invention is their least partial acid solubility in the pH range of 2.5 to 5, preferably 3.5 to 4.5. The products that meet this requirement are at least partly dissolved by a solution of 2.5 ml concentrated formic acid in 100 ml water. This acid solubility test is carried out as follows:

A suspension of 2 gm of aluminosilicates (related to the anhydrous active substance) in 100 ml distilled water is mixed slowly under stirring in the course of 8 to 30 minutes at a temperature of 22° C. with 2 ml of concentrated formic acid. For aluminosilicates that can be used according to the invention, the pH value, of the suspension after the total addition of the 2 mg formic acid must be above 2.5, between 2.5 and 5.5., and preferably between 3.5 and 4.5. If these pH values are attained in the titration, we have an aluminosilicate which is suitable for use according to the invention in view of its acid binding power. Products where a pH value outside this range is found according to this method, have either a too low acid binding power or a too high alkalinity, and are not usable in the sense according to the invention. For strict neutralizing purposes, which are not the subject of the present invention, aluminosilicates with a higher alkalinity can also be used.

The calcium binding power can be determined as follows:

1 liter of an aqueous solution containing 0.594 g $CaCl_2$ (=300 mg CaO/1=30°dH) (German hardness degrees), and standardized with diluted NaOH to a pH value of 10, is mixed with 1 gm of the aluminosilicate, calculated as an anhydrous product. Then the suspension is stirred vigorously for 15 minutes at a temperature of 22° C. After filtering off the aluminosilicate, the residual hardness x of the filtrate is determined, from which the calcium binding power is calculated in mg CaO/gm of aluminosilicate according to the formula $(30-x)\cdot 10$. For short hand purposes the above procedure is hereafter referred to as the Calcium Binding Power Test Method.

The defatting and pretanning of pickled dehaired hides is done the conventional way, e.g., in the tanning tumbler. Thereby the aluminosilicates are used preferably in combination with surface-active compounds or tensides, specifically anionic and nonionic tensides. Suitable anionic tensides are primarily high molecular weight sulfates or sulfonates having 8 to 18 carbon atoms, such as primary and secondary alkyl sulfates, alkyl sulfonates, or alkylaryl sulfonates, preferably alkylphenyl sulfonates. Suitable nonionic tensides are, for example, the adducts of from 5 to 30 mols of ethylene oxide onto higher fatty alcohols, fatty acids or fatty amines having 8 to 18 carbon atoms, and alkylphenols having 8 to 18 carbon atoms in the alkyl. The anionic and nonionic tensides can be used to advantage in admixture, however, or also singularly depending on the type of defatting and pretanning.

It is feasible also to add aluminosilicates as separate auxiliary agents to conventional liquors or to apply them in combination with a minor percentage of acidic chrome tanning agents.

Applied to the process according to the invention, from 10 to 50 gm/liter of tensides and from 10 to 50 gm/liter of aluminosilicates are required.

To support the lipsolubility effect of the cleansing liquor on defattying high-fat content pickled hides further solvents for fats in amounts of from 50 to 100 gm/liter can be added. Suitable solvents are selected from the group of petroleum hydrocarbons, hydrogenated aromatic hydrocarbons or hydroaromates, alkylbenzenes and mineral oils. Generally however, the use of solvents can be foregone.

The tanning of pelts and leather equally is carried out the conventional way, whereby according to leather type the known tanning materials, e.g., vegetable-synthetic tanning materials, chrome tanning materials, etc., are used with addition of electrolytes, such as common salt, inorganic or organic acids, such as sulfuric acid, formic acid or acetic etc. Pickling and tanning can be combined the usual way. Subsequently, a post-tanning and oiling of the leather can take place.

With above tanning processes, the application of aluminosilicates amounts to from 5 to 80 gm/liter of tanning liquor.

Aluminosilicates can be used advantageously also for leather neutralizing purposes, because they decompose in an acidic medium by binding acid and formation of alkali metal and aluminum salts as well as of polymeric silicic acids. In this case, 2 to 20 gm/liter of aluminosilicates are required.

Through the application, according to the invention, of the water-insoluble aluminosilicates, the initially described advantages over conventional leather production processes are obtained. Aluminosilicates in the dry powder stage can be easily transformed to stable dispersions by stirring in water or dispersing agent containing solutions, and in this form can be easily handled and diluted with water without any problem.

In the method according to the invention, the concentration of the chromium salts in the tanning liquor can be reduced by 25% to 50% as compared with the standard tanning methods.

The following preparations and examples are illustrative of the practice of the invention without being limitative in any manner.

PREPARATIONS

I. The production of suitable alkali metal aluminosilicates

The silicate solution was added to the aluminate solution under vigorous agitation in a vessel having a capacity of 15 liters. Agitation was effected at 3000 r.p.m. by means of an agitator having a dispersing disc. The two solutions were at room temperature. An X-ray amorphous sodium aluminosilicate was formed as a primary product of precipitation with an exothermic reaction. After agitating for 10 minutes, the suspension of the precipitation product was transferred to a crystallizer and, for the purpose of crystallization, remained in the crystallizer for 6 hours at 90° C. under agitation (250 r.p.m.). The mother liquor was drawn off from the crystal sludge and the filtration residue was washed with deionized water until the washing water flowing off had a pH value of approximately 10. Therefore the washed filtration residue was dried as specified. Instead of the dried sodium aluminosilicate, the suspension of the crystallization product or the crystal sludge was also used to produce the auxiliary soaping agents. The water contents were determined by heating the predried products to 800° C. for 1 hour. The sodium aluminosilicates, washed or neutralized to the pH value of approximately 10, and then dried, were subsequently ground in a ball mill. The grain size distribution was determined by means of a sedimentation balance.

Conditions for producing sodium aluminosilicate A

| | |
|---|---|
| Precipitation: | 2.985 kg of aluminate solution of the composition: 17.7% $Na_2O$, 15.8% $Al_2O_3$, 66.6% $H_2O$ 0.15 kg of caustic soda 9.420 kg of water 2.445 kg of a 25.8% sodium silicate solution of the composition 1 $Na_2O$ . 6.0 $SiO_2$, freshly prepared from commercially available water glass and slightly alkali-soluble silicic acid |
| Crystallization: | 6 hours at 90° C. |
| Drying: | 24 hours at 100° C. |
| Composition: | 0.9 $Na_2O$ . 1 $Al_2O_3$ . 2.04 $SiO_2$ 4.3 $H_2O$ (= 21.6% $H_2O$) |
| Degree of crystallization: | Fully crystalline |
| Calcium binding power: | 170 mg CaO/gm active substance. |

The particle size distribution, determined by sedimentation analysis, resulted in a mixture range of the particle size distribution curve at 3 to 6μ.

The sodium aluminosilicate A exhibits the following interference lines in the X-ray diffraction graph:

| d values, photographed with Cu—Kα radiation in Å |
|---|
| I |
| — |
| 12.4 |
| — |
| 8.6 |
| 7.0 |
| — |
| 4.1 (+) |
| — |
| 3.68 (+) |
| 3.38 (+) |
| 3.26 (+) |
| 2.96 (+) |
| — |
| — |
| 2.73 (+) |
| — |
| 2.60 (+) |

It is quite possible that all these interference lines will not appear in the X-ray diffraction graph particularly when the aluminosilicates are not fully crystallized. Thus, the most important d values for characterizing these types have been characterized by a "(+)".

Conditions for producing sodium aluminosilicate B

| | |
|---|---|
| Precipitation: | 7.63 kg of an aluminate solution of the composition 13.2% $Na_2O$; 8.0% $Al_2O_3$; 78.8% $H_2O$; 2.37 kg of a sodium silicate solution of the composition 8.0% $Na_2O$; 26.9% $SiO_2$; 65.1% $H_2O$; |
| Preparation ratio in mol: | 3.24 $Na_2O$; 1.0 $Al_2O_3$; 1.78 $SiO_2$; 70.3 $H_2O$; |
| Crystallization: | 6 hours at 90° C.; |
| Drying: | 24 hours at 100° C.; |
| Composition of the dried product | 0.99 $Na_2O$ . 1.00 $Al_2O_3$ . 1.83 $SiO_2$ . 4.0 $H_2O$; (= 20.9% $H_2O$) |
| Crystalline form: | Cubic with greatly rounded corners and edges; |
| Average particle diameter: | 5.4μ |
| Calcium binding power: | 172 mg CaO/gm active substance. |

Conditions for producing sodium aluminosilicate C

| | |
|---|---|
| Precipitation: | 12.15 kg of an aluminate solution of the composition 14.5% $Na_2O$; 5.4% $Al_2O_3$; 80.1% $H_2O$; 2.87 kg of a sodium silicate solution of the composition 8.0% $Na_2O$; 26.9% $SiO_2$; 65.1% $H_2O$; |
| Preparation ratio in mol: | 5.0 $Na_2O$; 1.0 $Al_2O_3$; 2.0 $SiO_2$; 100 $H_2O$; |
| Crystallization: | 1 hour at 90° C.; |
| Drying: | Hot atomization of a suspension of the washed product (pH 10) at 295° C.; Content of solid substance in the supension 46%; |
| Composition of the dried product: | 0.96 $Na_2O$ . 1 $Al_2O_3$ . 1.96 $SiO_2$ . 4 $H_2O$; |
| Crystalline form: | Cubic with greatly rounded corners and edges; Water content 20.5%; |
| Average particle diameter: | 5.4μ |
| Calcium binding power: | 172 mg CaO/gm active substance. |

Conditions for producing potassium aluminosilicate D

The sodium aluminosilicate C was produced in the first instance. After the mother liquor had been drawn off, and the crystalline mass had been washed to the pH value 10 with demineralized water, the filtration residue was suspended in 6.1 l of a 25% KCl solution. The suspension was heated for a short time to 80° to 90° C., and was then cooled, filtered off again and washed.

| | |
|---|---|
| Drying: | 24 hours at 100° C.; |
| Composition of the dried product: | 0.35 $Na_2O$ . 0.66 $K_2O$ . 1.0 $Al_2O_3$ 1.96 $SiO_2$ . 4.3 $H_2O$; (water content 20.3%) |

Conditions for producing sodium aluminosilicate E

| | |
|---|---|
| 1 Precipitation: | 0.76 kg of aluminate solution of the composition: 36.0% $Na_2O$, 59.0% $Al_2O_3$, 5.0% water 0.94 kg of caustic soda; 9.94 kg of water; 3.94 kg of a commercially available sodium silicate solution of the composition: 8.0% $Na_2O$, 26.9% $SiO_2$, 65.1% $H_2O$; |
| Crystallization: | 12 hours at 90° C.; |
| Drying: | 12 hours at 100° C.; |
| Composition: | 0.9 $Na_2O$ . 1 $Al_2O_3$ . 3.1 $SiO_2$ . 5 $H_2O$; |
| Degree of crystallization: | Fully crystalline. |
| The maximum range of the particle size distribution curve at 3 to 6μ | |
| Calcium binding power: | 110 mg CaO/gm active substance. |

The aluminosilicate E exhibited the following interference lines in the X-ray diffraction graph:

| d-values, photographed with Cu—$K_\alpha$radiation in Å |
|---|
| 14.4 |
| — |
| 8.8 |
| — |
| — |
| 4.4 |
| — |
| 3.8 |
| — |

-continued

| d-values, photographed with Cu—$K_\alpha$ radiation in A |
|---|
| — |
| — |
| — |
| 2.88 |
| 2.79 |
| — |
| 2.66 |
| — |

Conditions for producing sodium aluminosilicate F

| | |
|---|---|
| Precipitation: | 10.0 kg of an aluminate solution of the composition: 0.84 kg $NaAlO_2$ + 0.17 kg NaOH + 1.83 kg $H_2O$; 7.16 kg of a sodium silicate solution of the composition 8.0% $Na_2O$, 26.9% $SiO_2$, 65.1% $H_2O$; |
| Crystallization: | 4 hours at 150° C.; |
| Drying: | Hot atomization of a 30% suspension of the washed product (pH 10); |
| Composition of the dried product: | 0.98 $Na_2O$ . 1 $Al_2O_3$ . 4.12 $SiO_2$ . 4.9 $H_2O$; |
| The particles were of spherical shape; the average diameter of the balls was approximately 3 to 6μ. | |
| Calcium binding power: | 132 mg CaO/gm active substance at 50° C. |

Conditions for producing sodium aluminosilicate G

| | |
|---|---|
| Precipitation: | 7.31 kg aluminate (14.8% $Na_2O$, 9.2% $Al_2O_3$, 76.0% $H_2O$) 2.69 kg silicate (8.0% $Na_2O$, 26.9% $SiO_2$, 65.1% $H_2O$); |
| Preparation ratio in mol: | 3.17 $Na_2O$, 1.0 $Al_2O_3$, 1.82 $SiO_2$, 62.5 $H_2O$; |
| Crystallization: | 6 hours at 90° C.; |
| Composition of the dried product: | 1.11 $Na_2O$ . 1 $Al_2O_3$ . 1.89 $SiO_2$, 3.1 $H_2O$ (= 16.4% $H_2O$); |
| Crystalline structure: | Mixed structural type in the ratio 1:1; |
| Crystalline form: | Rounded crystallites; |
| Average particle diameter: | 5.6μ; |
| Calcium binding power: | 105 mg CaO/gm active substance at 50° C. |

Conditions for producing sodium aluminosilicate H produced from kaolin

1. Destructuring Kaolin

In order to activate the natural kaolin, samples of 1 kg were heated to 700° C. in a Schammote crucible for 3 hours. The crystalline kaolin $Al_2O_3.2SiO_2.2H_2O$ was thereby converted to the amorphous metakaolin $Al_2O_3.2SiO_2$.

2. Hydrothermal treatment of metakaolin

The alkali solution was placed in an agitating vessel and the calcined kaolin was added under agitation at temperatures between 20° and 100° C. The suspension was brought to the crystallization temperature of 70° to 100° C. under agitation, and was maintained at this temperature until the crystallization operation had terminated. The mother liquor was subsequently drawn off and the residue was washed with water until the washing water draining off had a pH value of from 9 to 11. The filter cake was dried and was subsequently crushed to a fine powder or was ground to remove the agglomerates produced during drying. This grinding process was omitted when the filtration residue was further processed in a wet state or when the drying operation was performed by means of a spray dryer or a flow dryer. Alternatively, the hydrothermal treatment of the calcined kaolin can be performed in a continuous operation.

| | |
|---|---|
| Preparation: | 1.65 kg of calcined kaolin 13.35 kg of 10% NaOH, mixed at room temperature; |
| Crystallization: | 2 hours at 100° C.; |
| Drying: | 2 hours at 160° C. in a vacuum drying cabinet; |
| Composition: | 0.88 $Na_2O$ . 1 $Al_2O_3$ . 2.14 $SiO_2$ 3.5 $H_2O$ (= 18.1% $H_2O$); |
| Crystalline structure: | Mixed structural type like Na aluminosilicate G, although in the ratio 8:2. |
| Average particle diameter: | 7.0μ. |
| Calcium binding power: | 126 mg CaO/gm active substance. |

Conditions for producing sodium aluminosilicate J produced from kaolin

The destructuring of the kaolin and the hydrothermal treatment were effected in the same manner as in the case of H.

| | |
|---|---|
| Preparation: | 2.6 kg of calcined kaolin; 7.5 kg of 50% NaOH, 7.5 kg of water glass, 51.5 kg of deionized water, mixed at room temperature; |
| Crystallization: | 24 hours at 100° C. without agitation; |
| Drying: | 2 hours at 160° C. in a vacuum drying cabinet; |
| Composition: | 0.93 $Na_2O$ . 1.0 $Al_2O_3$ . 3.60 $SiO_2$ . 6.8 $H_2O$ (= 24.6% $H_2O$); |
| Crystalline structure: | Sodium aluminosilicate J in accordance with above definition, cubic crystallites; |
| Average particle diameter: | 8.0μ |
| Calcium binding power: | 105 mg CaO/gm active substance. |

Preparation of sodium aluminosilicate K in granulated form

For the preparation of the granulated alkali metal aluminosilicates utilizable according to the invention, dried, finely-divided crystalline aluminosilicates which still contained 15 to 25% bound water were employed as starting materials.

50 kg of a powdered, crystalline, dried aluminosilicate of the composition 0.9 mole $Na_2O$.1 mole $Al_2O_3$. 2.04 moles $SiO_2$.4.3 moles $H_2O$ (aluminosilicate A), were suspended in a 300 l agitator vessel with 180 l water, and standardized to a pH value of 6 with 25% hydrochloric acid. This suspension was stirred moderately for 40 minutes. Then the aluminosilicate was separated on a vacuum filter, and the filter cake was washed out three times with 20 l water each. The aluminosilicate was dried in a drying cabinet for 10 hours at 105° C.

This dried aluminosilicate was mixed with 10 kg of bentonite and 20.1 kg of water, which had been standardized to a pH value of 6 with 25% hydrochloric acid, and the mixture was homogenized for 20 minutes in a 100 kg "Loedige" mixer (blade mixer by Loedige). Under continued mixing and gradual addition of 13.5 kg of additional water, which had likewise been standardized to a pH of 6 with 25% hydrochloric acid, within another 8 minutes the desired granulated product was obtained.

The granulated material was dried in a drying cabinet for 60 minutes at 150° C. and solidified by subsequent heating (15 minutes at 780° C.).

In order to determine the exchange power, 1 gm of the granulated material was boiled in 500 ml tap water of 16° dH for 5 minutes. After cooling and filtering, the residual hardness of the resultant filtrate was determined as discussed above. The calcium binding power of the product was 120 mg CaO/gm active substance. The particle size was 0.08 to 2 mm.

When an Eirich turbo mixer (pan/turbo mixer by Eirich) was used, the required homogenization and granulation periods were shorter. When the above-described procedure was used for the preparation of sodium aluminosilicate A in granulated form, the homogenization and the granulation were already completed after 5 minutes (instead of 28 minutes in the blade mixer). After drying for 15 minutes at 100° C. and calcining for 5 minutes at 800° C. in an air muffle furnace, a granulated product was obtained with a good exchange power, good hot water resistance, and good grain stability.

The calcium binding power of the product was 110 mg CaO/gm of active substance. The particle size was 0.08 to 2 mm.

In a corresponding manner, other granulated products of alkali metal aluminosilicates can also be prepared with particle sizes of more than 25μ to 5 mm, if alkali metal aluminosilicates of the types B to J are treated according to the above-described procedure.

Other granulating methods, like those described in U.S. Pat. No. 3,356,450 and German Pat. No. 1,203,238 are also suitable for the preparation of the alkali metal aluminosilicates to be used according to the invention.

Preparation of aluminosilicate L

A product of the composition $0.98Na_2O.Al_2O_3.1.96SiO_2.4.2H_2O$, prepared according to the instructions for alkali metal aluminosilicate C, was suspended in a solution containing calcium chloride. Under exothermic reaction, sodium was exchanged against calcium. After a reaction time of 15 minutes, the product was filtered off and washed, then spray-dried at an atomization temperature of 198° to 250° C. by hot atomization of a 40% suspension. The product obtained had the following characteristics:

| | |
|---|---|
| Composition: | $0.28\ Na_2O\ .\ 0.7\ CaO\ .\ Al_2O_3\ .\ 1.96\ SiO_2\ .\ 4\ H_2O$ |
| Calcium binding power: | >20 mg CaO/gm of active substance |
| Particle size: | Mean particle diameter: 5.8μ |
| Crystal form: | A-type, crystalline |

Preparation of aluminosilicate M

An aluminosilicate of the composition $0.89Na_2O.Al_2O_3.2.65SiO_2.6H_2O$ was suspended in a solution containing magnesium chloride. After a reaction time of 30 minutes at 80° to 90° C., the product was filtered off and washed. The drying was effected as shelf-drying for 16 hours at 100° C. The product obtained had the following characteristics:

| | |
|---|---|
| Composition: | $0.52\ Na_2O\ .\ 0.47\ MgO\ .\ Al_2O_3\ .\ 2.61\ SiO_2\ .\ 5.6\ H_2O$ |
| Calcium binding power: | >25 mg CaO/gm of active substance |

-continued

| | |
|---|---|
| Particle size: | Average particle diameter: 10.5μ |

Preparation of aluminosilicate N

An X-ray amorphous aluminosilicate of the composition $1.03Na_2O.Al_2O_3.2.14SiO_2.5.8H_2O$ was treated in the manner described under aluminosilicate M in a solution containing zinc sulfate; subsequently it was washed and dried under mild conditions. The product obtained had the following characteristics:

| | |
|---|---|
| Composition: | $0.92\ Na_2O\ .\ 0.11\ ZnO\ .\ Al_2O_3\ .\ 1.98\ SiO_2\ .\ 6\ H_2O$ |
| Calcium binding power: | 76 mg CaO/gm of active substance |
| Particle size: | Average particle diameter: 36μ |

Preparation of aluminosilicate O 50 kg of aluminosilicate L were suspended in a 300 l agitator vessel with 180 l water and standardized with 25% hydrochloric acid to a pH of 6. The suspension was stirred moderately vigorously for 40 minutes. Then the aluminosilicate was filtered off, washed repeatedly with water and dried for 10 hours at 105° C. The dried aluminosilicate was mixed with 10 kg of bentonite, and 20 l of water, which had been standardized with 25% hydrochloric acid to a pH of 6, and homogenized in a 100 kg blade mixer for 20 minutes. A granulated product was obtained within another 8 minutes under stirring, by adding gradually 13.5 l water, which had been standardized to a pH of 6. The granulated product was dried for 60 minutes at 150° C. and solidified by heating for 15 minutes to 780° C. The particle size distribution of the aluminosilicate O thus obtained was from 1 to 2 mm.

Preparation of aluminosilicate P

In a vessel of 1.5 l capacity, were charged 80 gm of a 15% solution of hexadecyl-trimethyl-ammonium chloride and 140 gm of a 35% sodium silicate ($Na_2O:SiO_2=1:3.4$), dissolved in 550 ml water. Under vigorous mixing, 46 gm of sodium aluminate (38% $Na_2O$, 52% $Al_2O_3$), dissolved in 150 ml water, and immediately thereafter 43.9 gm of $MgSO_4.7H_2O$, dissolved in 100 gm of water, were added. After stirring for 3 hours, the product thus formed was filtered off, washed with water, and the filter residue was dried for 35 hours at 100 torr and 80° C. The product obtained had the following characteristics:

| | |
|---|---|
| Composition: | $0.6\ Na_2O\ .\ 0.24\ MgO\ .\ 0.83\ Al_2O_3\ .\ 2.0\ SiO_2\ .\ 4.8\ H_2O$ and 7% hexadecyl-trimethyl-ammonium chloride |
| Calcium binding power: | 84 mg CaO/gm of active substance |
| Particle size: | Average particle diameter: 16μ (after grinding) |

Preparation of aluminosilicate Q

In a vessel of 1.5 l capacity were charged 142.9 gm of a 35% sodium silicate ($Na_2O:SiO_2=1:3.4$), dissolved in 507.4 gm of water, and mixed under stirring with 48.3 gm of sodium aluminate (38% $Na_2O$, 52% $Al_2O_3$), dissolved in 150 gm of water. Subsequently 42.4 gm of $Al_2(SO_4)_3.18H_2O$, dissolved in 100 gm of water, were added and then, after stirring for 10 minutes, 8 gm of a 50% solution of sodium dodecyl-benzene sulfonate were added. After stirring for another 160 minutes, the suspension was treated as described under aluminosilicate P. The product obtained of the composition $1.0Na_2O.Al_2O_3.2.1SiO_2.4.1H_2O$ with 2.1% sodium dodecyl-benzene sulfonate, with a calcium binding power of 128 mg CaO/gm of active substance and an average particle diameter of 19μ, was treated for 30 minutes at 60° C. with a diluted aluminum sulfate solution. After filtration, washing and subsequent drying at 80 torr and 100° C. for 6 hours, the solid substance was ground. The product obtained had the following characteristics:

| | |
|---|---|
| Composition: | 0.59% $Na_2O$ . 1.1 $Al_2O_3$ . 1.98 $SiO_2$ . 4.9 $H_2O$ |
| Calcium binding power: | 56 mg CaO/gm of active substance |
| Particle size: | Average particle diameter: 50μ |

The aluminosilicates, where Cat in the above formula denotes an alkali metal ion and/or a bivalent and/or trivalent cation, x a number from 0.5 to 1.8, where the particle size is 0.1μ to 5 mm, y denotes, on the one hand, a number from 0.8 to 6 with a calcium binding power of 0 to >20 mg and, on the other hand, a number from >6 to 50 with a calcium binding power of 0 to 200 mg CaO/gm of anhydrous active substance, can be prepared principally in the same manner as described in the above-described production methods. Beyond that, a part of the products are naturally occurring aluminosilicates.

Preparation of aluminosilicate R

In a vessel of 15 l capacity, an aluminate solution of the composition 0.84 kg $NaAlO_2$, 0.17 kg NaOH, 1.83 kg $H_2O$, was mixed with 7.16 kg of a sodium silicate solution (8.0% $Na_2O$, 26.9% $SiO_2$, 65.1% $H_2O$). The stirring was done with a beam stirrer at 300 rpm. Both solutions were charged at room temperature. An X-ray amorphous sodium aluminosilicate was formed as a primary precipitation product. After stirring for 10 minutes, the suspension of the precipitation product was transferred to a crystallization vessel in which it remained for 8 hours under vigorous stirring (500 rpm) at 150° C. to effect the crystallization. After draining the liquor from the crystal sludge and washing with water until the outflowing water had a pH of about 11, the about 36% suspension of the washed product was dried by hot atomization. The product obtained, a synthetic crystalline zeolite (Analcite), had the following characteristics:

| | |
|---|---|
| Composition: | 1.05 $Na_2O$ . $Al_2O_3$ . 3.8 $SiO_2$ |
| Calcium binding power: | 0 mg CaO/gm of active substance |
| Average particle diameter: | 12.3μ |

Preparation of aluminosilicate S

The preparation was similar to that indicated for aluminosilicate R, except that 6.91 kg of aluminate (18.0% $Na_2O$, 11.2% $Al_2O_3$, 70.8% $H_2O$) and 3.09 kg of silicate (8.0% $Na_2O$, 26.9% $SiO_2$, 65.1% $H_2O$) were used for the precipitation. The crystallization of the precipitation product was effected at 100° C. for 4 hours. After washing, the filter cake was dried for 24 hours at 100° C. and subsequently crushed to a fine powder. The product obtained, a feldsparoid hydrosodalite, had the following characteristics:

| | |
|---|---|
| Composition: | 1 $Na_2O$ . $Al_2O_3$ . 2.1 $SiO_2$ |
| Calcium binding power: | 16 mg CaO/gm of active substance |
| Average particle diameter: | 6.1μ |

Preparation of aluminosilicate T

For the preparation of the aluminosilicate containing calcium ions, the 44% suspension of a crystalline sodium aluminosilicate of the composition $1.05Na_2O.Al_2O_3.1.93SiO_2$ was reacted with a concentrated calcium chloride solution. After filtering off the product laden with about 70% calcium, this process was repeated at 60° C. After drying, the product obtained had the following characteristics:

| | |
|---|---|
| Composition: | 0.05 $Na_2O$ . 0.94 CaO . $Al_2O_3$ . 1.92 $SiO_2$ |
| Active substance content: | 79% |
| Calcium binding power: | <15 mg CaO/gm of active substance |

Preparation of aluminosilicate U

For the preparation of the aluminosilicate containing magnesium ions, a 40% suspension of a crystalline sodium aluminosilicate of the composition $0.92Na_2O.Al_2O_3.2.39SiO_2$ was reacted with a concentrated magnesium sulfate solution at 80° to 90° C. for 30 minutes. After filtering off the product laden with magnesium, the treatment was repeated again. After drying, the product had the following characteristics:

| | |
|---|---|
| Composition: | 0.09 $Na_2O$ . 0.82 MgO . $Al_2O_3$ . 2.38 $SiO_2$ |
| Active substance content: | 78% |
| Calcium binding power: | <15 mg CaO/gm of active substance |

Preparation of aluminosilicate V

This aluminosilicate is a synthetic zeolite (Mordenite) where y has a value of >6 according to the abovementioned formula. The preparation of these aluminosilicates is described more in detail in the monography by Donald W. Breck, "Zeolites, Molecular Sieves", Wiley & Sons, New York. The synthetic Mordenite is prepared from the reaction components sodium aluminate and silica, at temperatures between 265° and 295° C. for 2 to 3 days and yields a product of the following composition:

$$1.0Na_2O.Al_2O_3.10SiO_2.6.7H_2O$$

Other aluminosilicates, where y has a value of >6 according to the above-mentioned formula, are characterized below by commercial products.

Aluminosilicate W

Commercial amorphous aluminosilicate, type "Zeolex 23 A" by Huber Corp.

| | |
|---|---|
| Composition: | 1.5 $Na_2O$ . $Al_2O_3$ . 12.2 $SiO_2$ |
| Active substance content: | 82% |

-continued

| | |
|---|---|
| Calcium binding power: | 40 mg CaO/gm of active substance |

Aluminosilicate X

Commercial amorphous aluminosilicate type "Zeolex 35 P" by Huber Corp.

| | |
|---|---|
| Composition: | 1.5 $Na_2O$ . $Al_2O_3$ . 11.8 $SiO_2$ |
| Active substance content: | 82% |
| Calcium binding power: | 46 mg CaO/gm of active substance |

Aluminosilicate Y

Commercial amorphous aluminosilicate, type "Silteg P 820" by Degussa.

| | |
|---|---|
| Composition: | 1.1 $Na_2O$ . $Al_2O_3$ . 14.8 $SiO_2$ |
| Active substance content: | 80% |
| Calcium binding power: | 36 mg CaO/gm of active substance |

Aluminosilicate Z

Natural zeolite (Clinoptilolite), as it is obtained in large quantities in open pit mining in the Western part of the United States.

| | |
|---|---|
| Composition: | 0.6 $Na_2O$ . $Al_2O_3$ . 8.3 $SiO_2$ |
| Active substance content: | 86% |
| Calcium binding power: | 0 mg CaO/gm of active substance |

EXAMPLES

EXAMPLE 1

Defatting and pretanning pickled sheep's dehaired hides for vegetable-tanned leather linings Sheep's pickled, dehaired hides (pH 1.8 in the hairless hide state) were tumbled for 90 minutes with 50% water at 38° C., containing 3% of alkylphenolpolyglycol ether (9.5 mols of ethylene oxide), 5% of aluminosilicate according to preparations A, B, E, K, L, R or V, subsequently diluted with 100% water heated to 38° C., and tumbled for another 60 minutes (hide pH 3.8 to 4.0). The liquor was discarded; then the hides were rinsed with water at 35° C. for 15 minutes.

Tanning

The defatted and pretanned hides were tumbled for 15 minutes with 100% water at 25° C., containing 10% of a commercial type of synthetic bright and mild tanning agent, and subsequently tumbled for 45 minutes in the same liquor with a 4% addition of a commercial tanning-stable oiling agent, and then tanned for four hours with 10% of mimosa-tanning agent (powder), 10% of quebracho-tanning agent (powder) added together.

Subsequently the leather was treated in fresh liquor for 30 minutes with 100% water containing 0.5% oxalic acid and brightened by setting the bath pH value to about 4.1 to 4.2. After rinsing the leather for ten minutes at 25° C., they are scoured and festoon dried the conventional way.

Without using the ecologically critical higher salt and polyphosphate amounts usually required for defatting and pretanning purposes, leather linings of a good quality are obtained.

Any of the aluminosilicates recited above can be employed with substantially equal effectiveness.

EXAMPLE 2

Defatting and pretanning sheep's pickled, dehaired hides for chrome tanned Nappa garment leather The fleshed, pickled, dehaired hides were defatted and pretanned (pH 3.8 to 4.0 in the dehaired hide state) as in Example 1. Subsequently they were rinsed at 35° C. until the liquor-runs off clear.

Tanning

100% water heated to 25%, containing 5% of a commercial chrome-tanning-stable, synthetic bright-tanning agent, a phenol condensation product, for example, Basgntan N, BASF, tumbled for 30 minutes, there was subsequently added 20% of commercial mild-tanning chrome-tanning agent, for example, Chromosal B, Bayer, A.G. The tanning time was five hours (pH about 3.8 in bath). The leather was horsed up for one to two days and subsequently shaved.

Post-Tanning

200% water was heated to 45° C. and rinsed for ten minutes. A fresh liquor of 100% water was heated to 45° C. containing 3% of mild-tanning commercial chrome tanning agent, for example, Chromosal B—15 minutes transit time.

2% of a chrome-tanning stable and sunfast oiling agent, such as a sulfited natural oil—45 minutes transit time;

4% of a mild-tanning, neutral auxiliary tanning agent, such as a neutralized naphthalene condensation product, for example, Tamol NNA, BASF-transit time 30 minutes;

pH 4.4 in bath, subsequently rinsed at 50° C. for ten minutes.

Oiling

150% water, 50° C.

5% to 7% commercial softener type natural or synthetic leather oiling agents, for example, a chloroparaffin sulfonate—transit time 45 minutes.

The leather was further processed and festoon dried in the customary manner. This way without the accompanying use of common salt or polyphosphates customarily required for depickling and defatting, a good quality Nappa leather was obtained.

EXAMPLE 3

Sheep's hide tanning

Well washed and optionally bleached sheep's hides were rinsed in a hide paddle vat for 15 minutes at 35° C.

Pickling and tanning

Water 30° to 35° C., liquor ratio 1:20, containing 60 gm/liter common salt, 5 gm/liter of commercial electrolyte-stable hide oiling agent, for example, a chloroparaffin sulfonate—transit time 30 minutes.

5 gm/liter of organic low molecular weight acids, e.g., acetic acid/formic acid mixtures, transit time three hours, subsequently let stand overnight, 4 to 5 gm/liter commercial powdered chrome tanning agent, for example, Chromosal B, Bayer, A.G.

7 gm/liter of aluminosilicate according to preparation A, B, C, K, M, S or W-transit time 3 hours, subsequently let stand overnight (pH in liquor about 4.0).

Subsequently rinsed for 15 minutes, horsed and festoon dried.

This way about one-third to one-half of customarily used amounts of chrome tanning agent are saved, so that the ecologically critical chrome content in the drain water drops to about 0.2 to 0.6 gm/liter without a loss in quality of the sheep's hide leather.

Any of the other aluminosilicates recited can be employed with substantially equal effectiveness.

EXAMPLE 4

Chrome tanning of cowhide upper leather

Customarily limed, delimed and bated cowhide was pickled after a brief rinsing at 20° C.

Common pickling and tanning

100% water at 20°, containing
7% table salt
transit time ten minutes, followed by adding
0.6% formic acid, transit time twenty minutes,
0.6% sulfuric acid, transit time two hours,
overnight in bath (pH in hide 3.5),
8% of a commercial powdered chrome tanning agent, for example, Chromosal B, Bayer, A.G.
3% aluminosilicate according to preparation A, C, D, K. Q, T or X—transit time five hours (pH in bath about 3.8).

The tanned leathers were horsed overnight, and subsequently shaved, neutralized, post-tanned and oiled. Subsequently the leathers were dried and finished the customary way.

By this procedure of the invention, chrome tanning agent can be decreased from a standard 10% to less than 8% without any reduction in leather quality. By this process, chrome content in sewage waters of about 8 gm/liter $Cr_2O_3$ can be reduced to less than 1.3 gm liter.

Any of the other aluminosilicates recited can be employed with substantially equal effectiveness.

EXAMPLE 5

Neutralization of cowhide upper leather

Preliminary stages as with Example 4.

Neutralization

Shaved leather (pH 3.7 to 4.2)
rinsed at 35° C. for ten minutes.
100% water at 35° C., containing
0.5% to 1% aluminosilicate according to preparation B, G, F, K. L, U or Z,
transit time thirty minutes,
pH in the cut leather 4.5 to 4.7.

Further stages as with Example 4.

This way a neutralization effect was produced, connected with a certain amount of post-tanning, whereby a leather grain reinforcing effect was observed.

Any of the other aluminosilicates recited can be employed with substantially equal effectiveness.

EXAMPLE 6

Tanning of white cowhide leathers

Hide pretreatment including deliming and bating was of a customary type.

Common pickling and tanning

100% water at 20° C., containing
7% table salt, transit time ten minutes,
0.7% formic acid, transit time fifteen minutes,
0.7% sulfuric acid, transit time two hours.

The dehaired hides were let stand overnight in the pickling bath (pH in the cut dehaired hide 3.2).

8% Aluminosilicate according to preparation A, C, D, F, K, O, R or X into the same bath,
1.5% sulfuric acid, transit time five hours (pH in bath about 4.2).

Subsequently horsed and shaved.

Post-tanning and oiling

Shaved leathers were rinsed at 40° C. for ten minutes and treated in fresh liquor with 100% water, 40° C., containing
6% of a neutral mild and bright tanning synthetic auxiliary tanning agent, such as a neutralized naphthalene condensation product, for example, Tamol NNO, BASF,
transit time 30 minutes,
10% commercial electrolyte and tanning matter stable fat liquor suitable for white leather, such as sulfited natural oil, transit time 45 minutes,
4% of commercial tawing agent, such as a phenol condensation product, for example, Basyntan WL, BASF, transit time 30 minutes in same liquor.
New liquor.
200% water, 45° C., containing
0.3% oxalic acid, transit time 15 minutes.
The leathers were horsed and festoon dried.

Any of the other aluminosilicates recited can be employed with substantially equal effectiveness.

By comparison with the customary tanning with aluminum tanning agents and tawing agents, the above combination of aluminosilicates and tawing agents produced a fuller leather having a waterproofness superior to that of superior quality types.

EXAMPLE 7

Degreasing and depickling pickled sheepskins

The pickled sheepskins (pH 1.8 to 2.0 in the skin) were milled for 15 minutes at 35° C. in the vat with
50% water
2% alkylphenol polyethyleneglycol ether (9.5 EO)
6% aliphatic hydrocarbons.

Subsequently, 5% aluminosilicate K, L, S or Anaconda 2021 were added. The pH value was standardized to 3.8 and milled for another 15 minutes. After discharging the liquor, the skins were well rinsed with 100% water at 38° C. for a period of four hours.

Instead of the aluminosilicates recited above, any one of the other described aluminosilicates can be utilized with substantially the same results.

The pretanned leathers can be fully tanned by chrome tanning or vegetable-synthetic tanning.

EXAMPLE 8

Degreasing and depickling pickled sheepskins

The pickled sheepskins (pH 1.8 to 2.0 in the skin) were milled for 15 minutes at 35° C. in the vat with
50% water
2% alkylphenol polyethyleneglycol ether (9.5 EO)
6% aliphatic hydrocarbons.

Subsequently,

5% aluminosilicate K, L, V or R and
0.25% chromium oxide in the form of a commercial basic chrome tanning salt, such as Chromosal B, Bayer AG.

were added. The pH value was standardized to 3.9 to 4.0, and the skins were milled for an additional 15 minutes. After discharging the liquor, the skins were rinsed with 100% water at 37° C. for four hours.

Any of the above aluminosilicates recited can be replaced with the described aluminosilicates with substantially equal effectiveness.

The pretanned leathers can be fully tanned by chrome, vegetable or synthetic tanning.

EXAMPLE 9

Manufacture of furniture cowhide

Dehaired hides, limed and delimed in known manner, with a hide thickness of 1.5 to 1.8 mm, were rinsed for 15 minutes with water at 35° C. For bating, the hides were milled for 30 minutes at 35° C. in the vat with
200.0% water
1.5% ammonium sulfate
0.3% acetic acid.
After the addition of 1% of a commercial bate, such as Oropon O, by Röhm, the milling was continued for another 60 minutes. The pH value in the skin is 7.8 to 8.0. Subsequently the hides were rinsed for 15 minutes with water at 22° C. and left running for ten minutes at 22° C. for the pickle treatment with
100% water
8% common salt,
then left running in the vat for 15 minutes while adding 0.7% formic acid and for another two hours while adding 0.7% sulfuric acid. The pH value in the hide is 3.5.

For the following tanning, the hides were first treated in the vat for 30 minutes with
0.5% of a $C_{14}$-$C_{18}$-alkyl sulfate,
2.0% of a commercial electrolyte-resistant agent, such as chloroparaffin sulfonate,
then left running for two and a half hours after the addition of 1.5% chromium oxide in the form of a commercial basic chrome tanning salt, such as Chromosal B, Bayer AG, and for another four hours after the addition of 2.6% aluminosilicate L, K, S or X.

The consumption of liquor in tanning was about 1.2 gm of chromium oxide per liter with a liquor with a pH of 4.0 in the liquor.

The leathers were processed as usual. Furniture and garment leathers of good quality were obtained with a soft, good feel. The content of chromium oxide is about 4.6% by weight of the leather with a 0% content of water.

Instead of the aluminosilicates recited, any of the other aluminosilicates described can be employed with equally good results.

EXAMPLE 10

Dehaired hides, limed and delimed in known manner, with a hide thickness of 2.5 to 3.0 mm were rinsed for 15 minutes with water at 35° C. For bating, the hides were milled in the vat for 30 minutes at 35° C. with
200.0% water
1.0% ammonium sulfate
0.2% acetic acid.
After adding 0.5% of a commercial enzyme bate, such as Oropon O, by Röhm, the hides were milled for another 20 minutes. The pH value of the hides is 8.0 to 8.2. Subsequently, the hides were rinsed for 15 minutes with water at 22° C. and left running for ten minutes at 22° C. for the pickle treatment with
100% water
8% common salt,
then for 15 minutes after adding 0.7% formic acid, and then for another two hours after adding 0.7% sulfuric acid. The hides were left standing in the bath overnight. The pH value in the hide is 3.5.

For the subsequent tanning, the hides were allowed to run for an additional three hours with 1.75% chromium oxide in the form of a commercial basic chrome tanning salt, such as Chromosal B, Bayer AG, and for an additional four hours after the addition of 3% aluminosilicate L, K, T or W.

The chromium oxide content of the remaining liquor at a pH value of the liquor of 4.0 is less than 1.3 gm/liter.

The leathers were processed as usual. Leathers of good quality with a chromium oxide content of 4.3% were obtained.

Instead of the aluminosilicates recited, any of the other aluminosilicates described can be employed with substantially equal results.

EXAMPLE 11

Unsplit hides, limed and delimed in know manner, with a hide thickness of over 4 mm, were rinsed for 15 minutes with water at 35° C. For bating, the hides were milled for 45 minutes at 35° C. in the vat with
200.0% water
2.0% ammonium sulfate
0.5% acetic acid.
After the addition of
0.5% of a commercial enzyme bate, such as Oropon O by Röhm,
the milling is continued for another 30 minutes. The pH value of the skin is 8.0. Subsequently, the hides were rinsed with water at 22° C. for 15 minutes and left running for ten minutes at 22° C. for the pickle treatment with
100% water
8% common salt,
then for ten minutes with the addition of 0.9% formic acid, and then for another two hours after the addition of 0.5% sulfuric acid. The pH value of the hides is 3.6.

For the following tanning, the hides were left running with
1.75% chromium oxide in the form of a commercial basic chrome tanning salt, such as Chromosal B, Bayer AG,
for four hours after the addition of 1.5% aluminosilicate L, K, U or Y at first for one hour, and after adding again 1.5% aluminosilicate L, K, U or Y for another three hours. The leathers were left standing in the liquor overnight, moving them occasionally.

The chromium oxide content of the remaining liquor was less than 1.5 gm/liter $Cr_2O_3$. The leathers were processed as usual. Upper leathers of standard quality were obtained with about 4.2% chromium oxide by weight based on leather with 0% of water.

Any of the above recited aluminosilicates may be replaced by the described aluminosilicates with substantially equal results.

The preceding specific embodiments are illustrative of the practice of the invention. It is to be understood, however, that other expedients known to those skilled in the art or disclosed herein, may be employed without departing from the spirit of the invention or the scope of the appended claims.

We claim:

1. In the process of tanning uncured hides comprising subjecting uncured hides to the action of an aqueous liquor containing basic metal salt tanning agents including chrome tanning agents, and tanning auxiliaries for a time sufficient to tan said hides, rinsing and recovering leather, the improvement consisting essentially of employing a water-insoluble aluminosilicate, containing bound water of the formula $$(Cat_{2/n}O)_x.Al_2O_3.(SiO_2)_y$$

wherein Cat represents a cation selected from the group consisting of alkali metals and mixtures of bivalent metal ions with at least 5 mol% of the mixture of alkali metal ions, n represents an integer from 1 to 3 of the valence of the cation, x is an integer from 0.5 to 1.8 and y is an integer from 0.8 to 50, said aluminosilicates having an average particle size in the range of 0.1μ to 5 mm and a calcium binding power of from 0 to 200 mg CaO/gm of anhydrous active substance measured at 22° C., as partial replacement of said basic metal salt tanning agent including chrome tanning agents and tanning auxiliaries.

2. The process of claim 1 wherein Cat represents an alkali metal, n is 1, x is an integer from 0.7 to 1.5, y is an integer from 0.8 to 6, said average particle size is from 0.1 to 25μ and said calcium binding power is from 20 to 200 mg CaO/gm of anhydrous active substance.

3. The process of claim 2, wherein said alkali metal is sodium, y is an integer from 1.3 to 4 and said average particle size is from 1 to 12μ.

4. The process of claim 3, wherein said aluminosilicate has the formula $$0.7\text{-}1.1\ M_2O.Al_2O_3.1.3\text{-}3.3\ SiO_2.$$

5. The process of claim 3, wherein said aluminosilicate has the formula $$0.7\text{-}1.1\ Na_2O.Al_2O_3.>2.4\text{-}3.3\ SiO_2.$$

6. The process of claim 3, wherein said aluminosilicate has the formula $$0.7\text{-}1.1\ Na_2O.Al_2O_3.>3.3\text{-}5.3\ SiO_2.$$

7. The process of claim 1, wherein said aluminosilicate has the formula $$0.7\text{-}1.1\ M_2O.Al_2O_3.1.3\text{-}2.4\ SiO_2\text{-}0.5\text{-}5.0\ H_2O$$

as produced from calcined kaolin.

8. The process of claim 1, wherein Cat represents an alkali metal, n is 1, x is an integer from 0.7 to 1.5, y is an integer from 0.8 to 6, said average particle size is from more than 25μ to 5 mm and said calcium binding power is from 20 to 200 mg CaO/gm of anhydrous active substance.

9. The process of claim 4, wherein said alkali metal is sodium and y is an integer from 1.3 to 4.

10. The process of claim 1, wherein Cat represents a cation mixture of at least 20% of alkali metals and at least 5% of at least one bivalent metal ion and/or trivalent metal ion.

11. The process of claim 10, wherein x represents an integer from 0.7 to 1.5, y represents an integer from 0.8 to 6, said calcium binding power is from 20 to 200 mg CaO/gm of anhydrous active substance.

12. The process of claim 11, wherein said alkali metal is sodium, and y represents an integer from 1.3 to 4.

13. The process of claim 1, wherein y represents an integer from 0.8 to 6 and said calcium binding power is from 0 to <20 mg CaO/gm of anhydrous active substance.

14. The process of claim 13, wherein y represents an integer from 1.3 to 4.

15. The process of claim 1, wherein y represents an integer from >6 to 50.

16. The process of claim 15, wherein y represents an integer from >6 to 20.

17. The process of claim 1, wherein Cat represents a cation selected from the group consisting of sodium, potassium, calcium, magnesium, zinc, and mixtures thereof.

18. The process of claim 1, wherein said water-insoluble aluminosilicates have at least partial water solubility at a pH in the range of 2.5 to 5.

19. The process of claim 18, wherein said pH range is from 3.5 to 4.5.

20. The process of claim 18, wherein said aluminosilicates have a calcium binding power of from 0 to <20 mg CaO/gm of anhydrous active substance.

21. The process of claim 20, wherein said partial solubility is in a solution of 2.5 ml of concentrated formic acid in 100 ml of water.

22. The process of claim 21, wherein said partial solubility is such that said aluminosilicates give a pH value of from 2.5 to 5 in a suspension on slow titration under stirring in the course of from 8 to 30 minutes at a temperature of 22° C. of a suspension of 2 gm of said aluminosilicates (based on the anhydrous active substance) in 100 ml of distilled water by 2 ml of concentrated formic acid.

23. The process of claim 22, wherein said pH value is from 3.5 to 4.5.

24. The process of claim 1 wherein the concentration of chromium salts in the tanning liquor is reduced by 25% to 50% as compared with standard tanning methods.

25. The process of claim 1, wherein said aqueous liquor contains from 5 to 80 gm/liter of said aluminosilicate.

26. In the process of defatting and pretanning of pickled dehaired hides comprising subjecting pickled dehaired hides to the action of an aqueous liquor containing (1) surface-active compounds selected from the group consisting of anionic surface-active compounds and nonionic surface-active compounds, (2) electrolytes, and (3) sequestering agents, rinsing and recovering defatted and pretanned hides, the improvement consisting essentially of employing a water-insoluble aluminosilicate, containing bound water, of the formula $$(Cat_{2/n}O)_x.Al_2O_3.(SiO_2)_y$$

wherein Cat represents a cation selected from the group consisting of alkali metals and mixtures of bivalent metal ions with at least 5 mol % of the mixture of alkali metal ions, n represents an integer from 1 to 3 of the valence of the cation, x is an integer from 0.5 to 1.8 and y is an integer from 0.8 to 50, said aluminosilicates having an average particle size in the range of 0.1μ to 5 mm and a calcium binding power of from 0 to 200 mg CaO/gm of anhydrous active substance measured at 22° C., as partial replacement of said surface-active compounds, electrolytes and sequestering agents.

27. The process of claim 26, wherein said aqueous liquor contains from 10 to 50 gm/liter of said surface-active compounds and from 10 to 50 gm/liter of said aluminosilicate.

28. The process of claim 26, wherein said surface-active compounds are selected from the group consisting of primary $C_{8-18}$ alkylsulfates, secondary $C_{8-18}$ alkylsulfates, $C_{8-18}$ alkanesulfonates, $C_{8-18}$ alkylbenzenesulfonates, adducts of 5 to 30 mols of ethylene oxide onto higher $C_{8-18}$ fatty alcohols, $C_{8-18}$ alkylphenols, $C_{8-18}$ fatty acids, $C_{8-18}$ fatty amines, and mixtures thereof.

29. Th process of claim 1, wherein said aqueous liquor is acidic from the presence of acid tanned leather therein and from 2 to 20 gm/liter of said aluminosilicate is added for neutralizing said acid tanned leather.

30. The process of claim 1 wherein said basic metal salt tanning agents are chrome tanning agents.

31. The process of claim 1 wherein said aqueous liquor has a pH of from 3 to 4.5.

32. The process of claim 25, wherein said aluminosilicate is employed in an amount of from 10 to 50 gm/liter.

* * * * *

UNITED STATES PATENT AND TRADEMARK OFFICE

CERTIFICATE OF CORRECTION

PATENT NO. : 4,272,242

DATED : June 9, 1981

INVENTOR(S) : JUERGEN PLAPPER ET AL.

It is certified that error appears in the above—identified patent and that said Letters Patent is hereby corrected as shown below:

Preamble page, [75]: The last inventor's name should read -- Herman J. F. Jansen --.

Column 10, line 22: After "leather" insert a comma -- , --.

Column 14, line 40: Before "precipitation" cancel "1".

Column 17, line 38: "1.9-" should read -- 1.96 --.

line 39: Delete "6".

Column 19, line 27: ">20" should read -- <20 --.

Column 30, line 3 (claim 29): "Th" should read -- The --.

Signed and Sealed this

First Day of June 1982

[SEAL]

Attest:

GERALD J. MOSSINGHOFF

Attesting Officer

Commissioner of Patents and Trademarks